US006565724B2

(12) United States Patent
Itsekson et al.

(10) Patent No.: US 6,565,724 B2
(45) Date of Patent: May 20, 2003

(54) SYSTEM AND METHOD FOR ELECTROCHEMICAL STABILIZATION OF SOIL AND THE STRENGTHENED SOIL STRUCTURE RESULTING FROM THE ABOVE METHOD

(76) Inventors: Alexander Itsekson, 7145 Pinehaven Rd., Oakland, CA (US) 94611; Vladimir Itsekson, 701 Plymouth Ave., San Francisco, CA (US) 94112; Boris Itsekson, 940 Presidio Ave., #304, San Francisco, CA (US) 94115

( * ) Notice: Subject to any disclaimer, the term of this patent is extended or adjusted under 35 U.S.C. 154(b) by 98 days.

(21) Appl. No.: 09/801,549

(22) Filed: Mar. 8, 2001

(65) Prior Publication Data

US 2002/0125144 A1 Sep. 12, 2002

(51) Int. Cl.[7] ..... B01D 61/42

(52) U.S. Cl. ..... 204/515; 405/128.1; 405/130; 405/258.1

(58) Field of Search ..... 204/515; 405/128.1, 405/130, 258.1

(56) References Cited

U.S. PATENT DOCUMENTS 5,584,980 A * 12/1996 Griffith et al. ..... 204/416
5,589,056 A * 12/1996 Pool ..... 204/515
5,616,235 A * 4/1997 Acar et al. ..... 204/515
5,656,144 A * 8/1997 Hoover et al. ..... 204/515

FOREIGN PATENT DOCUMENTS

JP 7-180135 7/1995

* cited by examiner

*Primary Examiner*—Arun S. Phasge

(57) ABSTRACT

A plurality of rows of wells are drilled in the soil of the area to be stabilized, and then pairs of electrodes, i.e., an aluminum anode and a copper-graphite cathode connected to a source of a bipolar pulse current, are inserted into each well in such a manner that during operation all anodes of odd wells are connected to a positive terminal (for odd pulses) of the source, while all cathodes of even wells are connected to a negative terminal (for odd pulses) of the source. After a certain period of treatment the anodes and cathodes are reversed so that all anode of even wells are connected to the positive terminals (for even pulses) of the source, whereas the cathodes of the odd wells are connected to the negative terminal of the source. Controlled directional structuring of the soil mass is carried out by adjusting the duration of current pulses, intervals between two sequential bipolar pulses of pulse current, and current density in the pulses. Prior to initiation of the soil stabilization process, salts, which correspond to the type of treated soil, are introduced into the wells. Furthermore, water under pressure is fed to the area of the soil being current stabilized as an additional measure for affecting soil temperature control.

19 Claims, 6 Drawing Sheets

SYSTEM AND METHOD FOR ELECTROCHEMICAL STABILIZATION OF SOIL AND THE STRENGTHENED SOIL STRUCTURE RESULTING FROM THE ABOVE METHOD

FIELD OF THE INVENTION

The present invention relates to the field of soil mechanics, in particular to a system and method for electrochemical stabilization of soils of different types both on land and under water. The method and system of the invention may find use for protection of environment, stabilization of ocean, sea shores, and river banks from slides, as well as for strengthening of ocean and bay floors for extension of airport runways, for subgrade strengthening when constructing buildings and structures on weak or expansive soils, for construction of artificial shore structures in ocean and sea gulfs, bays, etc. The invention may also find use in oil recovery, mining, hydraulic engineering, irrigation, and road construction.

BACKGROUND OF THE INVENTION

Soil or sand erosion by wind and water is a problem in most countries, especially for those with arid climates that are characterized by low rain fall, high solar radiation, high temperature and high evaporation rates.

The structure of soil determines its properties such as permeability to water, porosity, crust formation, load-carrying capacity, etc. Therefore, an improved soil structure will reduce soil erosion by wind or water. It will also reduce water evaporation, increase intra- and inter particle linkages and increase the bonding strength of agglomerates so that they can sustain heavy weights. It will also increase the infiltration rate and reduction of water run-off. Improved structures are needed because weak soil and sand structure are problematic in roads and highway slopes, embankments, water channels, construction excavation banks, landing sites such as civil and military air fields, sand dunes movement, military camps, oil fields and agriculture.

Furthermore, mankind has gravitated to the water-land interface or littoral areas along lakes, rivers, bays, sounds and oceans for residential, commercial and recreational purposes. To further these purposes, many fixed shoreline structures have been built at considerable effort and cost. However, Nature constantly, albeit generally slowly, changes these shorelines through erosion, storms, and even earthquakes.

Recent statistics and studies indicate that increasing amounts of damage are occurring yearly to salt water shoreline areas in particular due to higher tidal levels and storms of increasing severity. According to Eugene Linden, "Burned by Warming", TIME, Mar. 14, 1994 (pg. 79), "such problems can be expected to intensify in the near future." Among the erosion problems encountered are the gradual or rapid direct erosion of bluffs or slightly elevated shorelines, loss of sand and pebbles from beach surfaces, destruction of piers, boathouses and other protruding or exposed artificial structures, and the washing away of sand dunes along the shoreline. In many barrier island areas such as Long Island, N.Y. and in the Carolinas, barrier islands have been eroded to the extent that dune systems are destroyed, new inlets and channels are formed for the ocean and adjacent waterways, and buildings, roads and other manmade structures are destroyed and/or swept away.

Furthermore, according to Glen Martin, "San Francisco Chronicle", Mar. 20, 2000, the problems associated with landslides are encountered in California. For the last two years California experienced a number of catastrophic landslides.

For centuries efforts have been made to stabilize soils and reinforce shoreline areas to prevent destruction of soils and shorelines.

Known methods and systems for stabilization of soil can be roughly divided into mechanical, chemical, and electrochemical. Mechanical methods and systems involve creation of reinforcement structures or mixing of the soil with reinforcement materials such as fibers, etc. Normally, such methods and systems are extremely expensive and therefore are applicable only to relatively small areas of low thickness.

Pure chemical methods and systems are based on the use of chemical substances which are introduced into soil and chemically interact between each other in the soil to form new compounds which bind soil particles and thus stabilize the soil. However, the aforementioned chemical reagents are extremely expensive and therefore purely chemical methods and systems also have limited application.

Electrochemical methods, to which the present invention pertains, consist in introduction into the soil of relatively inexpensive chemical substarces with subsequent application of electrochemical energy which generates such processes as electrolysis, electroosmosis, change in pH value of the soil, etc. These processes, in turn, cause secondary chemical reactions which produce soil binding compounds and thus reinforce and stabilize soils.

For example, U.S. Pat. No. 5,616,235 issued to Acar, et al. on Apr. 1, 1997 discloses a method for electrochemical stabilization of soils and other porous media. This method strengthens a soil by the addition of a cementing agent comprising an anion and a cation, wherein the combination of the anion and cation in the soil forms a cementitious product. More specifically, the method consists of applying an electric field in the soil between an anode and a cathode, supplying water to the soil near the anode, introducing the cation to the soil near the anode, thus causing migration of cations through the soil in the direction from the anode towards the cathode, introducing the anion to the soil near the cathode, thus causing migration of anions through the soil in the direction from the cathode towards the anode; and either introducing a base to the soil near the anode to neutralize protons generated by electrolysis of water at the anode or introducing an acid to the soil near the cathode to neutralize hydroxide generated by electrolysis of water at the cathode, or both. As a result, the cations and the anions are dispersed through the soil between the anode and the cathode, and the combination of the anions and cations in the soil forms a cementitious product. The method also comprises the step of supplying water to the soil near the anode. The cations and the anions can be introduced in an alternating mode.

A disadvantage of the aforementioned methods consists in that the soil stabilization process involves a plurality of sequential operations for introduction of various chemicals into different areas where anodes and cathodes are located. In other words, the process requires zoning of the entire area to be treated and marking of separate zones. This is a complicated, expensive, and time- and labor-consuming process. Therefore such a method is difficult to realize in practice on a fairly large area. Furthermore, the process requires that positions of cathode and anodes be clearly marked for low-skilled workers to know where and when to inject an appropriate chemical.

Japanese Laid-Open Patent Application (Kokai) Hei 7-180,135 issued Jul. 18, 1995 to Hisao Inutsuka describes a method and a system for improving and strengthening poor subsoil and soil by arranging a cathode and an anode in proper positions in the subsoil and soil having a relatively small coefficient of water permeability. A flow of electric current is then generated between the anode and the cathode. The cathode and anode can be made in the form of bars or plates. The electrodes are inserted into the unsolidified and uncontracted soil, a flow of direct electric current is then generated between the electrodes with simultaneous supply of water into the treated area. As a result the area in the vicinity of the cathode is solidified and contracted. The polarity of the electrodes is then reversed, whereby the soil is solidified and contracted in the vicinity of the former anode, i.e., current cathode. The inventor further claims different power sources, such as solar energy, wind energy, tidal energy, thermal energy obtained from garbage incineration, etc. for use in the method. Prior to use, the obtained electric energy is rectified into a direct current.

A common disadvantage of all known processes and systems for stabilization of soil described above is that they result in a non-uniform distribution of strength in the stabilized soil. This is because the known processes and systems do not allow to control temperature in the soil during stabilization. However, the known methods described above are accompanied by rapid variation of pH in the near-electrode areas, and as a result, by rapid variations of temperatures which are different in various zones and layers of the soil. Moreover, reversing of polarity of the electrodes causes further variation in three phases of the soil, i.e., in salt composition of a liquid phase, in composition of a gaseous phase with intensive generation of hydrogen near the cathode and of oxygen near the anode, and as a result, in decomposition of a solid phase with the formation of carbon dioxide and other gases. The aforementioned phenomena, in turn, cause vigorous secondary reactions with intensive and non-uniform generation of heat in various layers and zones of the soil mass. This results in aforementioned non-uniform strength in various vertical and horizontal sections of the soil. Another consequence of the aforementioned phenomena is polarization of electrodes which leads to non-controlled drop of electric current in the circuits.

OBJECTS OF THE INVENTION

It is an object of the present invention to provide a system and a method for electrochemical stabilization of soil which are inexpensive, are applicable for treating large areas to a significant depth, have an expanded range of applications, do not require zoning and marking of separate areas, and ensure uniform distribution of strength in the stabilized soil. Another object is to provide a strengthened soil structure which does not form an obstacle for natural underground water flows.

SUMMARY OF THE INVENTION

Multiple rows of wells are drilled in the soil of the area to be stabilized, and then pairs of electrodes, i.e., an aluminum anode and a copper-graphite cathode connected to a source of a bipolar pulse electric current, are inserted into each well in such a manner that during operation all anodes of odd wells are connected to a positive terminal (for positive pulses) of the source, while all cathodes of even wells are connected to a negative terminal (for positive pulses) of the source. After a certain period of treatment the anodes and cathodes are reversed so that all anode of even wells are connected to the positive terminals of the source, whereas the cathodes of the odd wells are connected to the negative terminal of the source. Controlled directional structuring of the soil mass is carried out by adjusting the duration of current pulses, intervals between two sequential bipolar pulses of pulse current, and current density in the pulses. Prior to initiation of the soil stabilization process, salts which correspond to the type of treated soil are introduced into the wells. Furthermore, water under pressure is fed to the area of the soil being currently stabilized as an additional measure for controlling soil temperature.

DETAILED DESCRIPTION OF THE INVENTION

Figure 1:
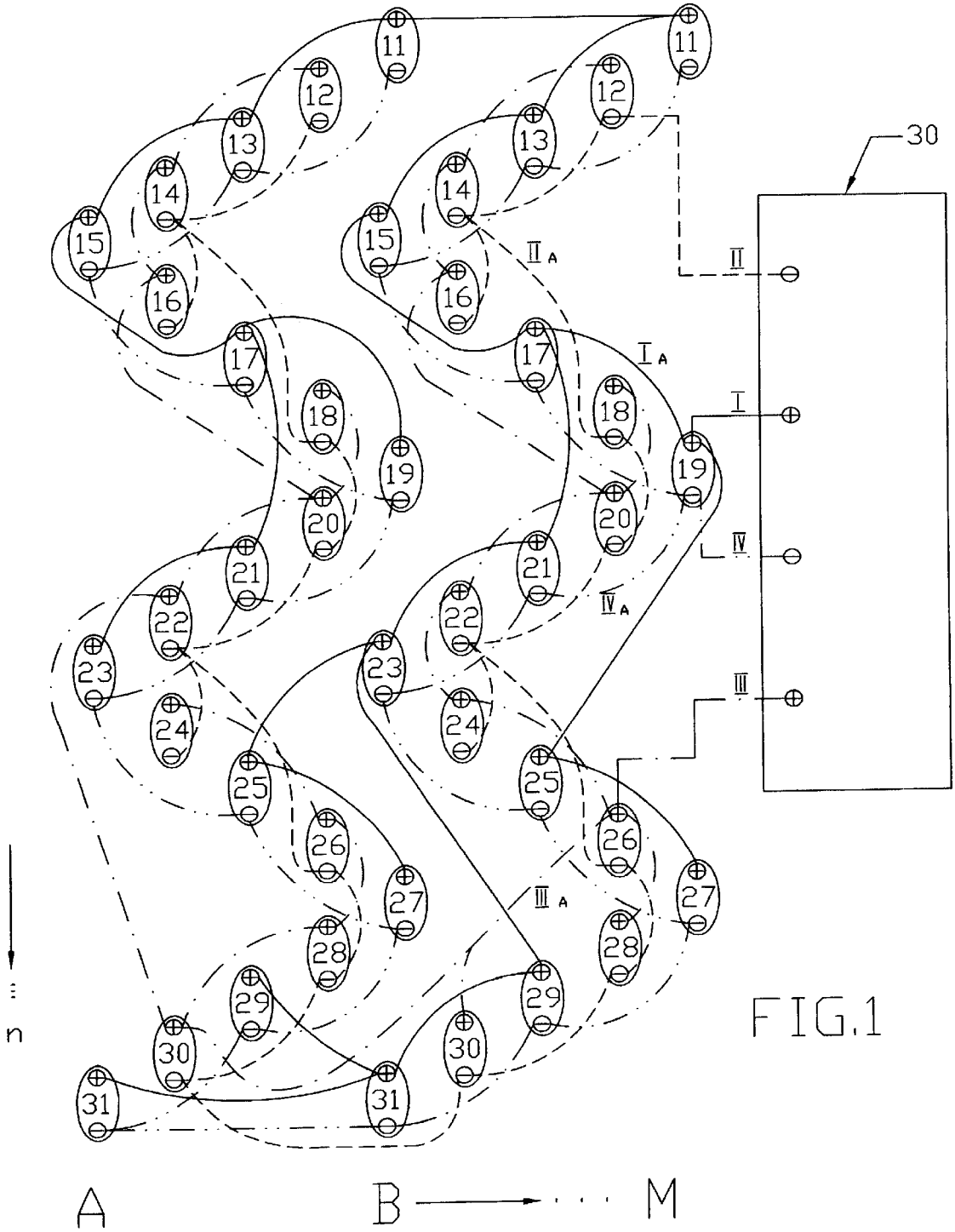
FIG. 1 is a plan view of the zone to be stabilized illustrating electrical connections between the electrodes of individual wells and power sources.
Figure 2:
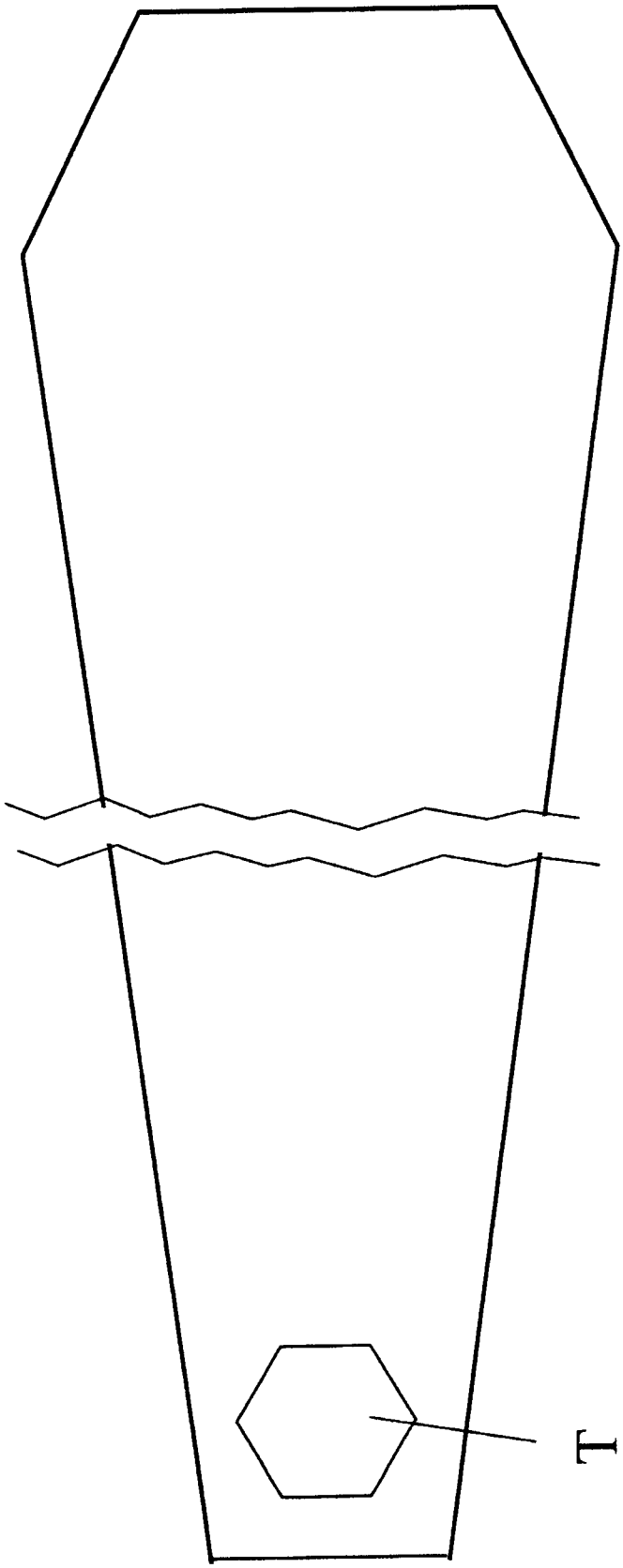
FIG. 2 is a view of an electrode.

FIGS. 1–4—System of the Invention with the Control of Electrodes via Polarized Relays An electric circuit of the soil stabilization system made in accordance with one embodiment of the invention is shown in FIG. 1. This drawing FIG. 1 is a plan view of the zone to be stabilized illustrating electrical connections between the electrodes of individual wells and power sources.

The system of FIG. 1 consists of multiple parallel nonrectilinear, e.g., zigzag rows of wells arranged drilled in the soil to be stabilized. Although only two rows A and B are shown in FIG. 1 for simplicity of the drawing, it is understood that a plurality, e.g., m of such rows at predetermined spacing covers the entire area to be treated. More specifically, the row A is formed by sequential wells A11, A12, A13 . . . An drilled from the surface layer to the stable soil layer, where n is the number of wells. Similarly, the next raw is formed by sequential wells B11, B12, B13 . . . Bn drilled from the surface to the stable soil layer. The last m-th row is formed by sequential wells M11, M12, M13 . . . Mn drilled from the surface to other stable soil layers.

Two electrodes, i.e., an anode and a cathode are inserted into each well to the very bottom of the well. The diameter of the wells is greater than the diameter of the electrodes, and the length of the wells is several times longer than the length of the electrodes. For examples, for the electrodes having a diameter from 25.4 mm (1") to 50.8 mm (2"), the wells should have a diameter from 25.4 cm (10") to 30.5 cm (12"). This is necessary to prevent physical contact between the anode and the cathode placed into the same well.

An anode 11*a* an cathode 11*b* are inserted into the well 11, an anode 12*a*, and a cathode 12*b* are inserted into the well 12, . . . an anode $N_a$ and a cathode $N_b$ are inserted into the well An. The electrodes may have a tapered shape shown in FIG. 2 to facilitate disconnection of the electrode from the stabilized soil when it is necessary to shift the electrode upward. A steel rope V is connected to the top of each electrode for manipulating it in the well. A temperature measuring device is inserted, e.g., into the lower end of each aluminum anode for measuring temperature of the soil during treatment. The electrode may have a length of about 4 meters (the length may vary depending on the depth of the soil to be treated), a 50.8 mm (2") diameter at the top and a 25.4 mm (1") diameter at the lower end. The anodes and cathode may have a rod-like shape shown in FIG. 2. The anode can be made, e.g., of aluminum, while the cathode can be made of copper-carbon compound.

All rows of the system of FIG. 1 are connected in parallel to a common power source 30. The source 30 is a bipolar source of a pulse current. It has two pairs of terminals of opposite polarities. More specifically, the power source 30 has a positive terminal 32*a* associated with a negative terminal 32*b* and a positive terminal 34*a* associated with a negative terminal 34*b*. Both pair of terminals, i.e., a pair of terminals 32*a*, 32*b* and a pair of terminals 34*a*, 34*b* operate in alternating order, i.e., they cannot work simultaneously, in order not to allow counteraction of electrodes in the same well. The power source 30 is capable of adjusting a duration of each bipolar pulse, time intervals between the sequential pulses, and current density in bipolar pulses which is required for adjusting the temperature in the soil being stabilized.

Figure 3:
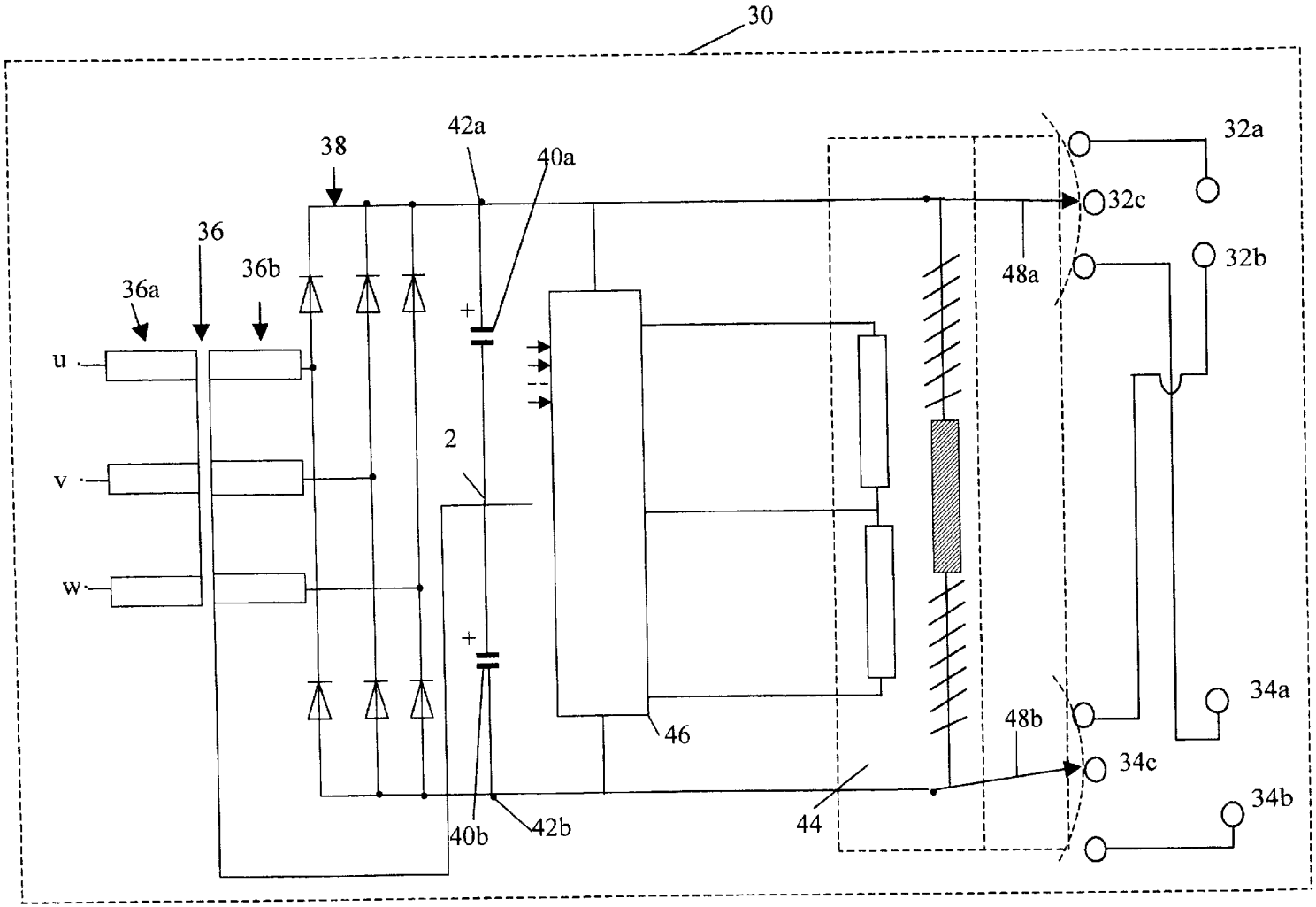
FIG. 3 is a simplified electric circuit of the power supply source used in the system of FIG. 1 with a polarized relay.

Bipolarity and adjustability of the power source 30 are provided by means of a control electric circuit of the power source 30 shown in FIG. 3 which is a simplified electric circuit of the power supply source used in the system of FIG. 1. As shown in this drawing, the circuit includes a three-phase transformer 36 having a primary winding 36*a* and a secondary winding 36*b*. The secondary winding 36*b* is connected to a six-phase current rectifier 38. Capacitors 40*a* and 40*b* are connected parallel to the rectifier 38 across respective positive and negative output terminals 42*a* and 42*b*. The circuit is further contains a temperature analyzer 46 of the same type is in the aforementioned U.S. Pat. No. 5,596,490. This analyzer contains a time relay (not shown). The output of the temperature analyzer 46 is connected to a polarized relay 44 which, in turn, is connected to a switch 48. The switch 48 consists of two interlocked contacts 48*a* and 48*b* and a neutral positions 32*c* and 34*c* between them, respectively.

The outputs of all temperature measuring devices T of all anodes 11*a*, 11*b*, . . . $N_a$ and $N_b$ are connected to the inputs of the temperature analyzer 46. This means that the temperature analyzer 46 should have as many inputs as the number of anodes, i.e., in the illustrated case this is 2n×m. The temperature analyzer 46 is capable of comparing the temperature data from all the wells with a preset maximum value, and to switch off the power supply 30 when this preset maximum value is reached.

Figure 4:
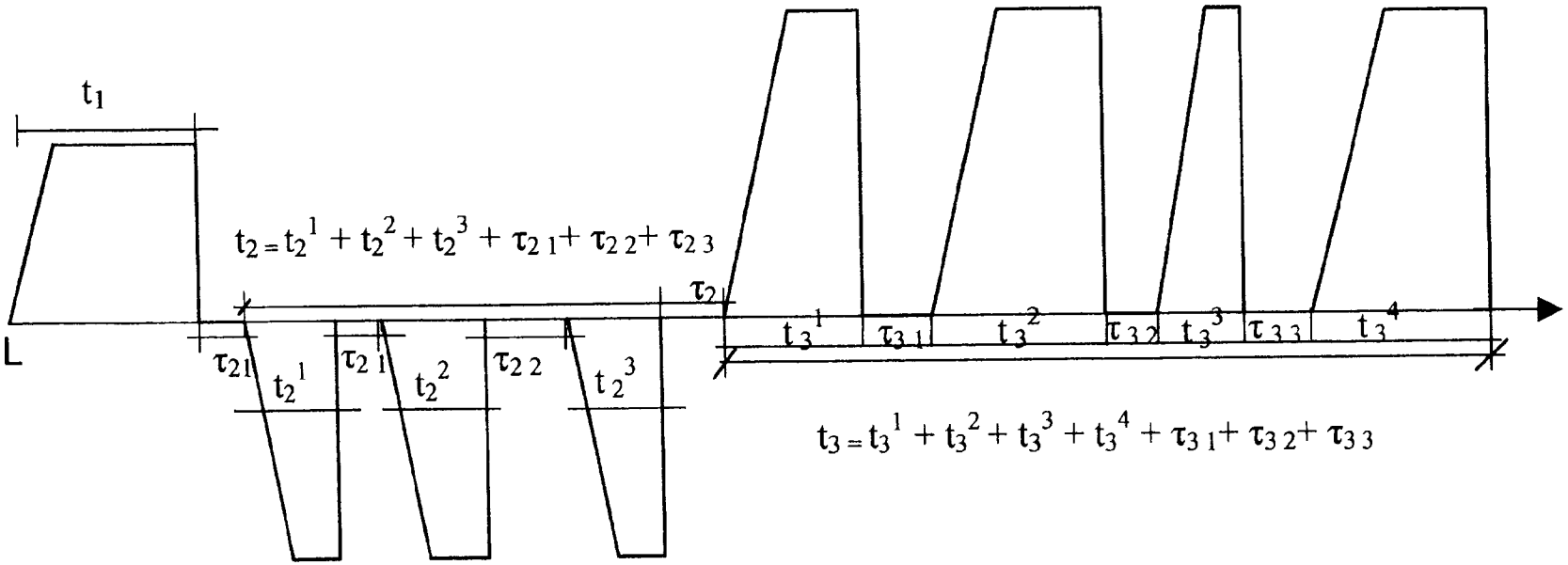
FIG. 4 is a time diagrams illustrating sequence of pulses and intervals between the pulses.

FIG. 4 is a time diagrams illustrating sequence of pulses and intervals between the pulses.

In the context of the present invention, the term "pulse" has a conventional meanings since each pulse may have a duration from several minutes to several tens minutes.

The first pulse $t_1$ is started when the contact 48*a* is closed on the terminal 32*a*, and the contact 48*b* is closed on terminal 32*b*. After the lapse of time prescribed by the temperature analyzer 46, the contacts 48*a* and 48*b* are switched to the neutral positions 32*c* and 34*c*, respectively. As a result, the power source 30 is switched off, and a first pause $\tau_1$ is started. After the pause $\tau_1$ is over, the temperature analyzer 46 sends a command to the polarized relay 44 for switching the contacts 48*a* and 48*b* over to the terminals 34*a* and 34*b*, whereby the first sub-pulse $t^1{}_2$ is initiated. In the same manner as described above, the temperature analyzer and the polarized relay 44 control the duration and sequence of the remaining subpulses and pauses $\tau_1$, $\tau_2$ between the subpulses $t^2{}_2$, $t^3{}_2$ in the pulse $t_2$.

In the diagrams of FIG. 4, the time is plotted on the ordinate axis, and the current is plotted on abscissa axis. FIG. 4 corresponds to two pairs of terminals 32*a*, 32*b* and terminals 34*a*, 34*b*. Let us call pulses $t_1$, $t_3$ . . . odd pulses, and pulses $t_2$, $t_4$ . . . even pulses.

In each raw, all anodes $N_{a\text{-}11}$, $N_{a\text{-}13}$, $N_{a\text{-}15}$ . . . $N_{a\text{-}n+1}$, $N_{b\text{-}11}$, $N_{b\text{-}13}$, $N_{b\text{-}15}$ . . . $N_{b\text{-}n+1}$, $N_{m\text{-}11}$, $N_{m\text{-}13}$, $N_{a\text{-}15}$ . . . $N_{m\text{-}n+1}$ of odd wells, which are arranged in an alternating order are electrically connected by conductors $I_A$, $I_B$ . . . $I_M$ (solid lines in FIG. 1) to a positive terminals 32*a* (for odd pulses on terminal 32*a*) of the source, while all cathodes $N_{a\text{-}12}$, $N_{a\text{-}14}$, $N_{a\text{-}16}$ . . . $N_{a\text{-}n}$, $N_{b\text{-}12}$, $N_{b\text{-}14}$, $N_{b\text{-}16}$ . . . $N_{b\text{-}n}$, $N_{m\text{-}12}$, $N_{m\text{-}14}$, $N_{a\text{-}16}$ . . . $N_{m\text{-}n}$ of even wells, which are arranged in an alternating order, are electrically connected by conductors $II_A$, $II_B$ . . . $II_M$ (dot lines in FIG. 1) to a negative terminal 32*b* (for odd pulses on terminal 32*b*).

In each raw, all anodes of even wells, i.e., $N_{a\text{-}12}$, $N_{a\text{-}14}$, $N_{a\text{-}16}$ . . . $N_{a\text{-}n}$, $N_{b\text{-}12}$, $N_{b\text{-}14}$, $N_{b\text{-}16}$ . . . $N_{b\text{-}n}$, $N_{m\text{-}12}$, $N_{m\text{-}14}$, $N_{a\text{-}16}$ . . . $N_{m\text{-}n}$, which are arranged in an alternating order, are electrically connected by conductors $III_A$, $III_B$ . . . $III_M$ (dash-and-dot lines in FIG. 1) to a positive terminals 34*a* (for even pulses on terminal 34*a*) of the source, while all cathodes of odd wells $N_{a\text{-}11}$, $N_{a\text{-}13}$, $N_{a\text{-}15}$ . . . $N_{a\text{-}n+1}$, $N_{b\text{-}11}$, $N_{b\text{-}13}$, $N_{b\text{-}15}$ . . . $N_{b\text{-}n+1}$, $N_{m\text{-}11}$, $N_{m\text{-}13}$, $N_{a\text{-}15}$ . . . $N_{m\text{-}n+1}$, which are arranged in an alternating order, are electrically connected by conductors $IV_A$, $IV_B$ . . . $IV_M$ (dash-and-two-dots lines in FIG. 1) to a negative terminal 34*b* (for even pulses on terminal 34*b*).

Operation of the System of FIGS. 1–4

Prior to a stabilization operation, i.e., prior to activation of the power source 30, all wells from 11 to n of all rows from A to M are loaded with chemicals required for soil stabilization.

For better understanding of the invention, it would be appropriate to briefly describe a mechanism of electrochemical stabilization with addition of various salts selected with regard to specific soils to be treated.

Two general processes accompany soil stabilization: (1) the application of electric fields, and (2) the injection of chemical stabilizers.

1. Electrically-induced transport phenomena have been used to consolidate or "pre-compress" soils. See I. Casagrande, "Electro-Osmosis in Soils," Geotechnique, vol. 1, pp. 159–177 (1949). The electrically-induced mechanisms include electromigration of ions, electrophoresis of charged species, and electroosmosis due to electromigration-induced pore fluid flow. In electroosmosis, the pore fluid moves due to the application of a constant, low DC current by electrodes inserted in soil.

In accordance with the invention, the directional structure formation is controlled by adjusting the kinetics of interaction between different phases (i.e., liquid, gaseous, and solid phases) of the soil mass and the salts added into the soil for the soil treatment. Such a control prevents vigorous and non-uniform increase in the soil temperature in different layers and zones of the soil mass. The increase of the soil temperature is limited by pauses between the subpulses within each bipolar pulse, while the current density is decreased by increasing the number of subpulses in each pulse.

The aforementioned control creates favorable conditions for steady coagulation processes and for better adhesion between soil particles uniformly distributed throughout the soil being strengthened.

The aforementioned processes of controlling kinetics of soil stabilization result not only in chemical and physical changes in the nature of the soil particle surfaces, but also in their chemical and mineralogical composition with the formation of new cementing substances and new mineral types. Together, these changes provide essentially higher uniformity in distribution of soil strength in different layers and zones of the soil mass. In addition, these changes significantly reduce electrode polarization. What is most important for strengthening foundations for airport runways extension into the ocean bays, is that the formation of new cementing substances and minerals can covert even loose sands into a monolithic stone-like bodies not only in air but also under water. A characteristic strengthened soils is that they do not absorb water and thus possess water-resistant properties.

When electrodes are placed in a soil that contains groundwater, electrolysis reactions generate an acidic medium at the anode and an alkaline medium at the cathode. The pH drops at the anode to below about 2, and increases at the cathode to above about 12 depending upon the total current applied and the type of soil. The acid front formed at the anode advances towards the cathode by different transport mechanisms, including migration due to electrical gradients, pore fluid advection due to prevailing electro-osmotic flow, any externally applied or internally generated hydraulic potential differences, and diffusion resulting from a generated chemical gradient. Unless the transport of this acid front is retarded by the buffering capacity of the soil, the chemistry across the specimen will be dominated by the transport of the hydrogen ion. The cation exchange capacity of the soil, the availability of organic species and salts (such as $CaCO_3$) that react with acid would affect the buffering capacity of the soil. Kaolinitic clay has a much lower buffering capacity compared with other clays such as montmorillonite or illite, due both to its lower cation exchange capacity and the naturally acidic nature of this clay.

Soil stabilization is carried out in several stages by shifting the electrodes in the wells from one vertical level to another, until the soil be treated over the entire thickness. For the first stage of stabilization the electrodes are inserted to the very bottom of all wells A11, A12, A13 . . . An, B11, B12 . . . Mn. Then fine-grained chemicals selected from the those required for stabilization of the type of soil and required for aforementioned processes of electrolysis and electroosmosis are loaded into each well to the level of the top ends of the electrodes. If the soil is not in a condition of maximum saturation with water, it should be saturated with water to the maximum possible level. This is achieved by drilling additional vertical holes (not shown) around each well and between the wells, and then by supplying water under pressure into these holes. More specifically, water under pressure is supplied to the anode area during the pause and just prior to the supply of a positive current pulse to this particular anode. Water is needed as an electroconductive medium for processes of electroosmosis. The power source 30 is then switched on under condition at which current pulses are supplied only to terminals 32*a* and 32*b*.

FIG. 4 is a time diagrams illustrating sequence of pulses and intervals between the pulses. In the diagrams of FIG. 4, the time is plotted on the ordinate axis, and the current is plotted on abscissa axis. FIG. 4 corresponds to two pairs of terminals 32*a*, 32*b* and terminals 34*a*, 34*b*. Let us call pulses $t_1$, $t_3$ . . . odd pulses, and pulses $t_2$, $t_4$ . . . even pulses.

In the context of the present invention, the term "pulse" has a conventional meanings since each pulse may have a duration from several minutes to several tens minutes.

The first pulse $t_1$ is started when the contact 48*a* is closed on the terminal 32*a*, and the contact 48*b* is closed on terminals 32*b*. After the lapse of time prescribed by the temperature analyzer 46, the contacts 48*a* and 48*b* are switched to the neutral positions 32*c* and 34*c*, respectively. As a result, the power source 30 is switched off, and a first pause $\tau_1$ is started. After the pause $\tau_1$ is over, the temperature analyzer 46 sends a command to the polarized relay 44 for switching the contacts 48*a* and 48*b* over to the terminals 34*a* and 34*b*, whereby the first sub-pulse $t^1_2$ is initiated. In the same manner as described above, the temperature analyzer and the polarized relay 44 control the duration and sequence of the remaining subpulses and pauses $\tau_1$, $\tau_2$ between the subpulses $t^2_2$, $t^3_2$ in the pulse $t_2$.

The third pulse $t_3$ begins after the completion of the last subpulse $t^3_2$ and the subsequent pause $\tau_2$. The third pulse $t_3$ is initiated by closing the contact 48*a* to the terminal 34*a*, and the contact 48*b* to the terminal 34*b*. It can be seen from the FIG. 4 that the third pulse $t_3$ has subpulses $t^1_3$, $t^2_3$ . . . shorter in time than the subpulses $t^1_2$, $t^2_2$ . . . of the second pulse $t_2$. This is because the third pulse is started when the soil has already been heated to a higher temperature than in the beginning of the preceding cycle.

In each raw, all anodes $N_{a\text{-}11}$, $N_{a\text{-}13}$, $N_{a\text{-}15}$ . . . $N_{a\text{-}n+1}$, $N_{b\text{-}11}$, $N_{b\text{-}13}$, $N_{b\text{-}15}$ . . . $N_{b\text{-}n+1}$, $N_{m\text{-}11}$, $N_{m\text{-}13}$, $N_{a\text{-}15}$ . . . $N_{m\text{-}n+1}$ of odd wells, which are arranged in an alternating order, are electrically connected by conductors $I_A$, $I_B$ . . . $I_M$ (solid lines in FIG. 1) to a positive terminals 32*a* (for odd pulses on terminal 32*a*) of the source, while all cathodes $N_{a\text{-}12}$, $N_{a\text{-}14}$, $N_{a\text{-}16}$ . . . $N_{a\text{-}n}$, $N_{b\text{-}12}$, $N_{b\text{-}14}$, $N_{b\text{-}16}$ . . . $N_{b\text{-}n}$, $N_{m\text{-}12}$, $N_{m\text{-}14}$, $N_{a\text{-}16}$ . . . $N_{m\text{-}n}$ of even wells, which are arranged in an alternating order, are electrically connected by conductors $II_A$, $II_B$ . . . $II_M$ (dot lines in FIG. 1) to a negative terminal 32*b* (for odd pulses on terminal 32*b*).

In each raw, all anodes of even wells, i.e., $N_{a\text{-}12}$, $N_{a\text{-}14}$, $N_{a\text{-}16}$ . . . $N_{a\text{-}n}$, $N_{b\text{-}12}$, $N_{b\text{-}14}$, $N_{b\text{-}16}$ . . . $N_{b\text{-}n}$, $N_{m\text{-}12}$, $N_{m\text{-}14}$, $N_{a\text{-}16}$ . . . $N_{m\text{-}n}$, which are arranged in an alternating order, are electrically connected by conductors $III_A$, $III_B$ . . . $III_M$ (dash-and-dot lines in FIG. 1) to a positive terminals 34*a* (for even pulses on terminal 34*a*) of the source, while all cathodes of odd wells $N_{a\text{-}11}$, $N_{a\text{-}13}$, $N_{a\text{-}15}$ . . . $N_{a\text{-}n+1}$, $N_{b\text{-}11}$, $N_{b\text{-}13}$, $N_{b\text{-}15}$ . . . $N_{b\text{-}n+1}$, $N_{m\text{-}11}$, $N_{m\text{-}13}$, $N_{a\text{-}15}$ . . . $N_{m\text{-}n+1}$, which are arranged in an alternating order, are electrically connected by conductors $IV_A$, $IV_B$ . . . $IV_M$ (dash-and-two-dots lines in FIG. 1) to a negative terminal 34*b* (for even pulses on terminal 34*b*).

Figure 5:
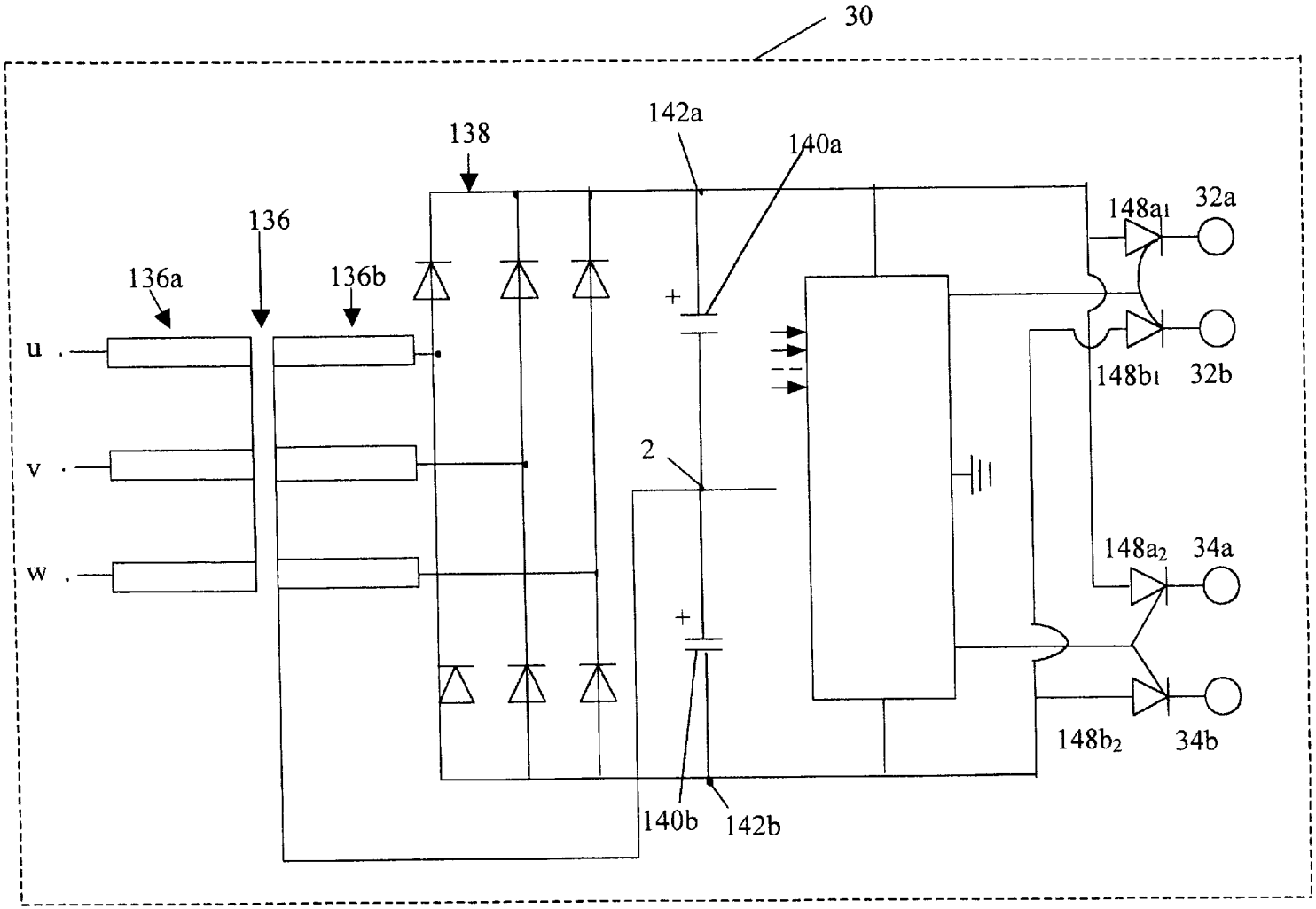
FIG. 5 is a simplified electric circuit of the power supply source similar to FIG. 1 in which the polarized relay are thyristors.
Figure 6:
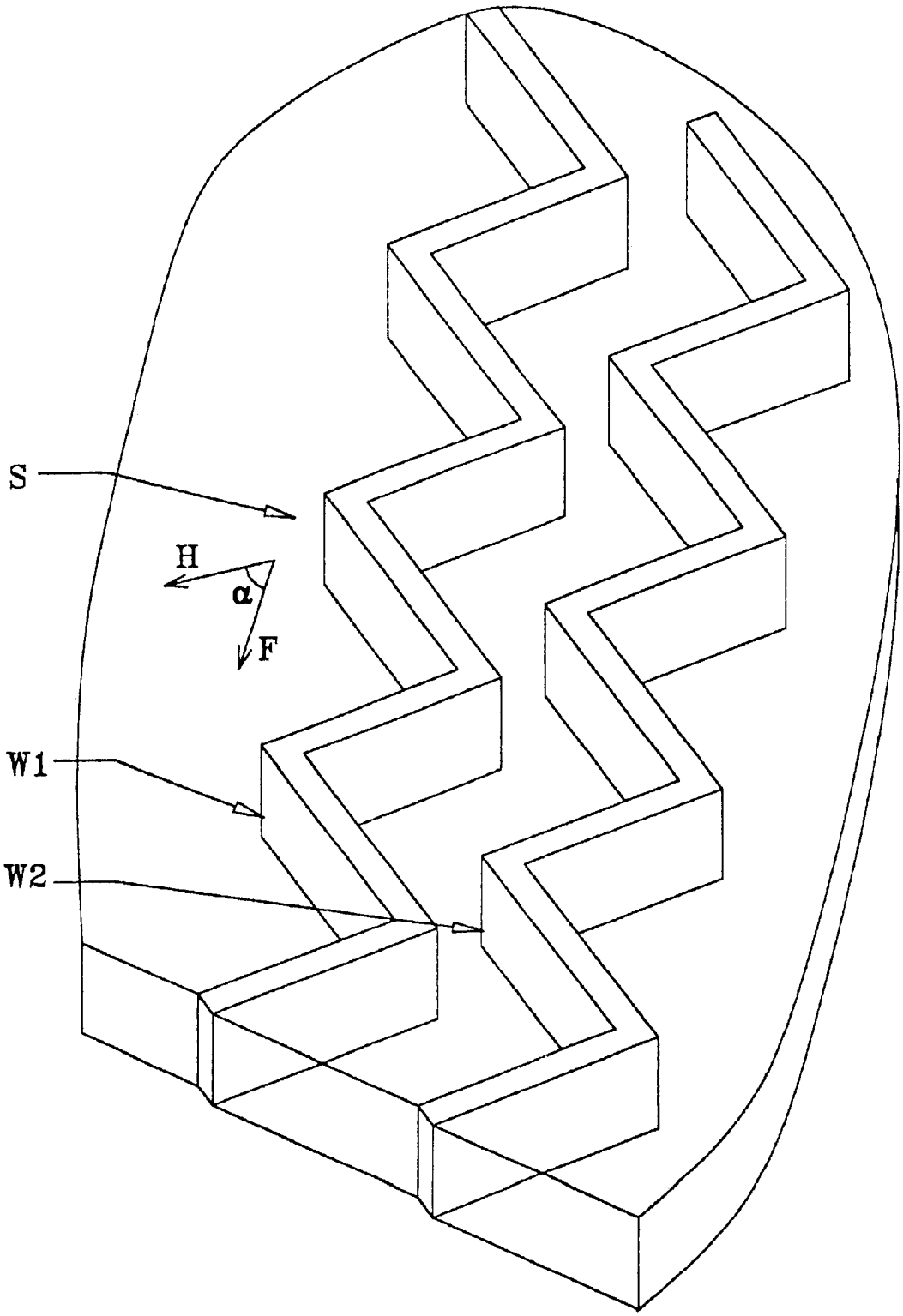
FIG. 6 is a three-dimensional view of the land area structure stabilized by the method of the invention.

FIGS. 5 and 6—System of the Invention with Remote Control of Electrode via Thyristors The embodiment described above with reference to FIGS. 1 through 4 relates to the system in which switching between the positive and negative current pulses is carried out with the use of a polarized relay.

All rows of the system of electrodes, which is the same for this embodiment as in FIG. 1, are connected in parallel to a common power source 130. The source 130 is the same as the source 30 of the previous embodiment.

Bipolarity and adjustability of the power source 130 are provided by means of a control electric circuit which is shown in FIG. 5. Since in general the system of the embodiment of FIG. 5 is similar to the one of the previous embodiment, identical parts of the system of FIG. 5 will be designated by the same reference numerals as in FIGS. 1 through 4 with an addition of 100 and their description will be omitted.

As shown in FIG. 5, the circuit includes a three-phase transformer 136 having a primary winding 136*a* and a secondary winding 136*b*. The secondary winding 136*b* is connected to a six-phase rectifier 138. Capacitors 140*a* and 140*b* are connected parallel to the rectifier 138 across power circuit outputs 142*a* and 142*b*. The power circuit output 142*a* is connected to a thyristor-type switch which is formed by a pair of thyristors $\mathbf{148}a_1$, $\mathbf{148}b_1$, and the power circuit output 142*b* is connected to a pair of thyristors $\mathbf{148}a_2$, $\mathbf{148}b_2$.

The aforementioned thyristors are commercially produced, e.g., by Eupec Co., Warstein, Germany and may have the power up to 1 Gigawatt.

The circuit is further contains a temperature analyzer 146. This analyzer contains a time relay (not shown). The outputs of the temperature analyzer 146 is connected to control circuits of the aforementioned pairs of thyristors $\mathbf{148}a_1$, $\mathbf{148}b_1$, and $\mathbf{148}a_2$, $\mathbf{148}b_2$. The output of thyristors $\mathbf{148}a_1$ is connected directly to the terminal 32*a*, and the output of thyristors $\mathbf{148}b_1$ is connected directly to the terminal 32*b* of the power supply unit 30 (FIG. 1). The output of thyristors $\mathbf{148}a_2$ is connected directly to the terminal 34*a*, and the output of thyristors $\mathbf{148}b_2$ is connected directly to the terminal 34*b* of the power supply unit 30.

The rest of the electric circuit of FIG. 5 is the same as in FIG. 3.

Operation of the Circuit of FIG. 5

The circuit of FIGS. 5 operates in the same manner as the one shown in FIGS. 3, with the exception that two pairs of thyristors $\mathbf{148}a_1$, $\mathbf{148}b_1$, and $\mathbf{148}a_2$, $\mathbf{148}b_2$ controlled by the temperature analyzer 146 are used instead of the polarized relay 44. In other words, a pair of thyristors $\mathbf{148}a_1$, $\mathbf{148}b_1$ are used for switching between the terminals 32*a* and 32*b*, whereas a pair of thyristors $\mathbf{148}a_2$ and $\mathbf{148}b_2$ are used for switching between the terminals 34*a* and 34*b*.

FIG. 6—Structure of the Stabilized Land Area

FIG. 6 is a schematic three-dimensional view of the land area structure stabilized by the method of the invention. In this drawing S designates the external surface of the slope. The direction of the slope is shown by arrow F with respect to the horizontal direction H. The slope angle is $\alpha$. It can be seen that the stabilized areas form a number of parallel vertical walls W1, W2 . . . Wm having a zigzag shape horizontal cross section. Each stabilized area is solidified to a stone-like soil body. Each solidified wall is rigidly connected to the layer which would have served as a sliding plane if the strengthening elements were not formed. The orientation of the solidified zigzag walls is selected parallel to the direction of flow of underground water. Thus, the new formations in the soil of the slope do not form an obstacle for natural water flows.

Each pair of adjacent zigzag walls form a channel for underground water. The zigzag shape can be different for different soils. Zigzags with acute angles are suitable for loose soils such as sands. Non-cohesive soils such as sands require zigzag shapes having angles, e.g., between 90 and 120°, whereas adhesive soils such as clays may require angles between 120° and 170°. A distance between two parallel zigzag walls depends on the saturation of the soil with water and the type of the soil. In sandy soils, the vertexes of the zigzag shapes of one solidified wall enter the spaces between the vertexes of the adjacent solidified wall. In cohesive soils, the plane passing through the vertexes of one solidified wall is spaced from the plane passing through the vertexes of the adjacent solidified wall.

Some soils have a top layer up to 3–4 meters with so-called expansive properties, which means that this layer has a tendency to expand the volume due to changes in soil's water content. For building structures on such soils, it is necessary either to remove the expandable layer and replace it with engineered fill or to anchor a new foundation system with drilled piers or piles embedded into a nonexpansive soil layer and to design this foundation system to resist extremely high upward soil pressure from the expansive soil. The method of this invention can be used for stabilizing or solidifying the aforementioned expandable layer for use as a foundation subgrade.

Thus, it has been shown that the invention provides a system and a method for electrochemical stabilization of soil which are inexpensive, are applicable for treating large areas to a significant depth, have an expanded range of applications, do not require zoning and marking of separate areas, and ensure uniform distribution of strength in the stabilized soil. The invention also provides a strengthened soil structure which does not form an obstacle for natural underground water flows.

The invention has been shown and described with reference to specific embodiments, which should be construed only as examples and do not limit the scope of practical applications of the invention. Therefore any changes and modifications in materials, shapes, electric diagrams and their components are possible provided these changes and modifications do not depart from the scope of the patent claims. For example, the anodes may have more than one temperature measuring devices which may be located in different places of the anode. The ranges of dimensions of electrodes is also given as an examples. The zigzag patterns was given as an example and can be, e.g., sinusoidal, staggered pattern, or any other nonrectilinear rows.

What is claimed is:

1. A system for electrochemical stabilization of soil on a selected area of land having a surface layer and a stable soil layer underneath the surface layer, comprising:

a plurality of wells drilled in said area of land from said surface layer with penetration into said stable soil layer, said plurality of wells being arranged in parallel nonrectilinear rows, and each row consists of odd wells and even wells arranged in an alternating order;

an anode and a cathode contained in each of said wells;

a bipolar source of pulse current comprising a first pair of terminals comprising a first positive terminal and a first negative terminal and a second pair of terminals comprising a second positive terminal and a second negative terminal;

power source control means for controlling said power source to provide a first condition, at which said first pair of terminals operates and said second pair of terminals does not operate, and a second condition, at which said second pair of terminals operates and said first pair of terminals does not operate;

a plurality of conductors, which under said first condition connects said anodes of said odd wells with said first positive terminal and said cathodes of said even wells with said first negative terminal, and which under said second condition connect said anodes of said even wells with said second positive terminal and said cathodes of said odd wells with said second negative terminal.

2. The system of claim 1, wherein each said anode of said odd wells and of said even wells in said plurality of rows has at least one temperature measuring device for measuring temperature of soil.

3. The system of claim 2, wherein said power source control means comprises:

a current rectifier having a negative output and a positive output;

a temperature analyzer having input terminals for each one of said temperature measuring devices;

a power source for said temperature analyzer; and switching means for switching said power source control means between said first condition and said second condition.

4. The system of claim 3, wherein said switching means comprise a polarized relay.

5. The system of claim 3, wherein said switching means comprise a thyristor-type switch.

6. A method for electrochemical stabilization of soil on a selected area of land having a surface layer and a stable soil layer underneath the surface layer, comprising:

drilling a plurality of wells in said area of land from said surface layer with penetration into said stable soil layer, said well being arranged in parallel nonrectilinear rows, each row consisting of odd wells and even wells arranged in an alternating order;

inserting an anode and a cathode into each one of said wells and to the bottom of said wells;

providing each one of said anodes with at least one soil temperature measuring device for measuring a temperature of said soil in the vicinity of each one of said anodes;

introducing soil-stabilizing chemical agents into each one of said wells to the level of said electrodes;

providing a bipolar power source of pulse current having a control circuit with a soil temperature analyzer, said bipolar power source being switchable under control of said temperature analyzer between a first condition in which the current flows through said soil from said anode of each one of said odd wells to said cathode of each one of said even wells, and a second condition in which current flows through said soil from said anode of each one of said even wells to said cathode of each one of said odd wells;

electrically connecting each one of said anodes and each one of said cathodes to said bipolar power source so as to ensure said first condition and said second condition;

energizing said bipolar power source under said first condition and electrically stabilizing said soil sequentially during at least a first period of time, a second period of time, and a third period of time, wherein said first period of time is carried out under said first condition continuously, said second period of time is carried out under said second condition with periodic interruptions of the supply of current from said bipolar power source, and said third period of time is carried out under said first condition with periodic interruptions of the supply of current from said bipolar power source.

7. The method of claim 6, wherein said first period of time, said second period of time, and said third period of time are determined by said control circuit.

8. The method of claim 6, wherein said soil has expansive properties and is being stabilized at said surface layer of the soil for use as a foundation subgrade.

9. The method of claim 6, wherein said step of electrochemically stabilizing said soil comprises at least processes of electrolysis, electroosmosis, and soil pH change, said method further comprising a step of supplying water to said soil if said soil is not sufficiently saturated with water for said process of electroosmosis.

10. The method of claim 6, wherein upon completion of soil stabilization process in said position at the bottom of said wells, each said anode and each said cathode are lifted together to another level of each said well and then all steps of soil stabilizing are repeated for said another level.

11. The method of claim 10, wherein said step of lifting is carried out in a stepwise manner to the top of each one of said wells.

12. The method of claim 6, further comprising the step of causing chemical and physical changes in the nature of the soil particle surfaces with the formation of new cementing substances as a result of said soil stabilization.

13. A method for electrochemical stabilization of soil on a selected area of land, having a surface layer and a stable soil layer underneath said surface layer, comprising:

drilling a plurality of wells in said area of land from said surface layer with penetration into said stable soil layer, said wells being arranged in parallel nonrectilinear rows, each of said rows consisting of odd wells and even wells arranged in an alternating order;

inserting an anode and a cathode into each one of said wells and to the bottom of said wells;

providing each one of said anodes with at least one soil temperature measuring device for measuring a temperature of said soil in the vicinity of each one of said anodes;

introducing soil-stabilizing chemical agents into each one of said wells to the level of said electrodes;

providing a bipolar power source of pulse current having a control circuit with a temperature analyzer;

providing switchable means for switching between a first condition in which current flows through said soil from said anode of each one of said odd wells to said cathode of each of said even well, and a second condition in which current flows through said soil from said anode of each one of said even wells to said cathode of each one of said odd wells;

electrically connecting each one of said anodes and each one of said cathodes to said a bipolar power source so as to ensure said first condition and said second condition;

energizing said bipolar power source under said first condition and electrochemically stabilizing said soil continuously during the first period of time which is determined by said control circuit;

choosing a criterion temperature of said soil corresponding to stabilization conditions of said soil;

controlling kinetics of soil stabilization process via said temperature analyzer by measuring temperature of said soil and comparing said temperature with said criterion temperature; and switching said bipolar power source to said second condition when said temperature reaches said criterion temperature and stabilizing said soil during the second period of time;

switching said bipolar power source to said first condition for a third period of time which is determined by said control circuit;

interrupting the supply of current to said bipolar power source during said second period of time and said third period of time.

14. The method of claim 13, where said second period of time and said third period of time are repeated in alternating sequence.

15. The method of claim 14, further comprising the step of supplying water to said soil for adjusting temperature of said soil.

16. The method of claim 14, further comprising the step of supplying water to said soil near said anode between said second period of time for adjusting temperature of said soil.

17. The method of claim 14, wherein said step of electrochemically stabilizing said soil comprises at least processes of electrolysis, electroosmosis, and soil pH change, said method further comprising a step of supplying water to said soil if said soil is not sufficiently saturated with water for said process of electroosmosis.

18. The method of claim 14, wherein upon completion of soil stabilization process in said position at the bottom of said wells, each one of said anodes and each one of said cathodes are lifted together to another level of each one of said wells, and then all steps of soil stabilization are repeated for said another level.

19. The method of claim 18, wherein said step of lifting is carried out in a stepwise manner to the top of each one of said wells.

* * * * *